US011428445B2

(12) United States Patent
Norris

(10) Patent No.: US 11,428,445 B2
(45) Date of Patent: Aug. 30, 2022

(54) SYSTEM AND METHOD OF PUMPED HEAT ENERGY STORAGE

(71) Applicant: Gridworthy Technologies LLC, Napa, CA (US)

(72) Inventor: Benjamin L. Norris, Napa, CA (US)

(73) Assignee: GRIDWORTHY TECHNOLOGIES LLC, Napa, CA (US)

( * ) Notice: Subject to any disclaimer, the term of this patent is extended or adjusted under 35 U.S.C. 154(b) by 309 days.

(21) Appl. No.: 16/561,536

(22) Filed: Sep. 5, 2019

(65) Prior Publication Data

US 2021/0071918 A1 Mar. 11, 2021

(51) Int. Cl.

| | |
|---|---|
| ***F25B 21/04*** | (2006.01) |
| ***F25B 30/06*** | (2006.01) |
| ***F28D 20/00*** | (2006.01) |
| ***F04B 19/24*** | (2006.01) |

(52) U.S. Cl.

CPC ..... *F25B 21/04* (2013.01); *F04B 19/24* (2013.01); *F25B 30/06* (2013.01); *F28D 20/0039* (2013.01); *F28D 20/0056* (2013.01); *F28D 2020/0004* (2013.01)

(58) Field of Classification Search

CPC ..... F25B 21/04; F25B 30/06; F04B 19/24; F28D 20/00; F28D 20/0056; F28D 20/0039; F28D 2020/0004; Y02E 60/14

USPC ..... 165/10, 236

See application file for complete search history.

(56) References Cited

U.S. PATENT DOCUMENTS

| | | | | |
|---|---|---|---|---|
| 8,826,664 | B2 * | 9/2014 | Howes | F01K 3/12 60/659 |
| 9,618,242 | B2 * | 4/2017 | Lombardo | B60H 1/00899 |
| 9,932,830 | B2 | 4/2018 | Laughlin | |
| 10,012,448 | B2 | 7/2018 | Laughlin et al. | |
| 10,094,219 | B2 | 10/2018 | Laughlin | |
| 10,233,787 | B2 * | 3/2019 | Larochelle | F25B 13/00 |
| 10,288,357 | B2 | 5/2019 | Laughlin et al. | |
| 10,900,372 | B2 * | 1/2021 | Graucob | H02K 7/1823 |
| 2006/0218924 | A1 * | 10/2006 | Mitani | F01K 3/02 60/659 |
| 2009/0179429 | A1 * | 7/2009 | Ellis | F01K 17/005 290/1 R |
| 2010/0257862 | A1 * | 10/2010 | Howes | F01K 3/06 60/682 |
| 2011/0070113 | A1 * | 3/2011 | Mohamed | H02K 7/1869 417/505 |

(Continued)

OTHER PUBLICATIONS

Morandin et al., "Thermoelectric energy storage: a new type of large scale energy storage based on thermodynamic cycles," 2011 World Engineers' Convention, Sep. 2011, 12 pages.

*Primary Examiner* — Len Tran
*Assistant Examiner* — Gustavo A Hincapie Serna
(74) *Attorney, Agent, or Firm* — Sheridan Ross P.C.

(57) ABSTRACT

Methods and systems for energy storage and management are provided. In various embodiments, heat pumps, heat engines and pumped heat energy storage systems and methods of operating the same are provided. In some embodiments, methods include controlling thermal properties of a working fluid by virtue of the timing of the operation of cylinder valves. Methods and systems for controlling mass flow rates and charging and discharging power independent of working fluid temperature and system state-of-charge are also provided.

19 Claims, 4 Drawing Sheets

(56) References Cited

U.S. PATENT DOCUMENTS

| | | | | |
|---|---|---|---|---|
| 2012/0312496 | A1* | 12/2012 | Howes | F02C 6/16 126/400 |
| 2013/0118170 | A1* | 5/2013 | Mierisch | F01K 3/12 60/659 |
| 2013/0118344 | A1* | 5/2013 | Howes | F01K 7/00 91/55 |
| 2015/0276326 | A1* | 10/2015 | Guidati | F25B 27/00 165/10 |
| 2016/0298455 | A1* | 10/2016 | Laughlin | F01L 1/02 |
| 2016/0298498 | A1* | 10/2016 | Kreuger | F28D 20/0034 |
| 2017/0159495 | A1 | 6/2017 | Laughlin et al. | |
| 2017/0159496 | A1 | 6/2017 | Laughlin et al. | |
| 2017/0159497 | A1 | 6/2017 | Laughlin et al. | |
| 2017/0159499 | A1 | 6/2017 | Laughlin et al. | |
| 2017/0159500 | A1 | 6/2017 | Laughlin et al. | |
| 2017/0350658 | A1* | 12/2017 | Kerth | F02C 1/10 |
| 2018/0087809 | A1* | 3/2018 | Ueda | F25J 1/0265 |
| 2018/0179960 | A1* | 6/2018 | Apte | F02C 6/14 |
| 2018/0187597 | A1* | 7/2018 | Apte | H02K 7/1823 |
| 2019/0153901 | A9 | 5/2019 | Laughlin et al. | |
| 2019/0195571 | A1 | 6/2019 | Laughlin et al. | |
| 2019/0360454 | A1* | 11/2019 | Torabi | F03B 17/005 |
| 2020/0032802 | A1* | 1/2020 | Mei | F01M 1/16 |
| 2020/0386122 | A1* | 12/2020 | Ford | F03G 7/04 |

* cited by examiner

SYSTEM AND METHOD OF PUMPED HEAT ENERGY STORAGE

FIELD

The present disclosure relates generally to energy storage systems. More specifically, embodiments of the present disclosure relate to the storage and management of electrical energy. The present disclosure provides systems and methods for converting electrical energy and mechanical energy to thermal energy for storage. Embodiments of the present disclosure further provide for reusing or reconverting stored thermal energy to mechanical and electrical energy.

BACKGROUND

Electrical energy may be stored and later recovered to temporally match electricity supply with demand. Storage may be used in combination with renewable, intermittent sources of power such as solar and wind generation to ensure that supply is available in sufficient quantities when required. Storage systems may be used to deliver low cost stored energy to loads during times when the cost or demand for energy is high. Storage may be used by electricity consumers to manage supply and demand in off-grid power systems or to supplement utility supply in a cost-effective manner depending on electric rate structure and policies for on-site generation. Stored energy may be used to supply energy to time-varying loads from relatively constant generation sources. Stored energy may be used as backup when primary sources such as the electrical utility or bulk power system are unavailable.

Electrical energy is typically converted to some other form of energy more suitable for storing. It is known that electrical energy can be converted to mechanical energy and then to thermal energy using a heat pump. The resulting thermal energy can be stored and later recovered using a heat engine to produce mechanical energy and this can be converted back to electrical energy.

In certain systems, a heat pump removes heat from a low temperature thermal storage reservoir and adds heat to a high temperature thermal storage reservoir. Drawing on the analogy of electrochemical batteries, this operational mode is called "charging." The stored energy is later recovered in the discharging mode using a heat engine operating between the same high and low temperature reservoirs. The use of a heat pump and a heat engine to thus store and recover thermal energy is referred to as pumped heat energy storage ("PHES"). The heat pump and heat engine may comprise the same equipment.

An important characteristic of PHES systems is round-trip efficiency, which is defined as electrical energy delivered out of the system over the discharging period divided by electrical energy delivered into the system during the charging period.

PHES may employ any of several thermodynamic cycles for charging and discharging between the two reservoir temperatures. A 2011 publication from World Engineer's Convention by Morandin et al. titled "*Thermo-Electrical Energy Storage: A New Type of Large-Scale Energy Storage Based on Thermodynamic Cycles*", which is hereby incorporated by reference in its entirety, discloses the selection of thermodynamic cycle, working fluid, and thermal storage media by considering operating temperatures, working fluid and storage media properties, equipment costs, and other factors. Morandin observes that the ambient environment may serve as either a cold or hot reservoir, effectively unlimited in thermal capacity and fixed in temperature. Such an approach may be used to increase storage density and lower cost by eliminating the need for physical reservoir material on one side or the other. Morandin, however, fails to disclose various features, systems and methods of present disclosure as will be shown and described herein.

Another variant of a PHES is described in U.S. Pat. No. 8,826,664 to Howes et al., which is hereby incorporated by reference in its entirety. Howes et al. disclose a system in which thermal energy is stored across two continuous ranges of temperature in gas permeable structures, such as particulate beds. Energy is stored in a hot reservoir at temperatures ranging continuously from the maximum design temperature down to ambient temperature. In a cold reservoir, temperatures range continuously from the minimum design temperature up to ambient temperature. Howes et al. provide a system that is inherently limited in storage density and fails to disclose various features, methods and systems of the present disclosure.

U.S. Pat. No. 10,012,448 to Laughlin et al., which is hereby incorporated by reference in its entirety, provides a system that employs a Brayton cycle with air or other inert gas used as a working fluid. When charging as a heat pump, the system uses a turbocompressor to compress the working fluid and raise its temperature, a heat exchanger to supply high temperature heat for storage, a turbine to expand the working fluid and decrease its temperature, and a second heat exchanger to draw low temperature thermal energy from the cold reservoir. To discharge, the same equipment operates as a heat engine with the cycle in reverse, drawing high temperature heat from the hot reservoir, rejecting energy at low temperature into the cold reservoir, and delivering useful work. The system of Laughlin et al. may be described as a PHES with a reversible Brayton cycle employing turbomachinery and heat exchangers in communication with the cold and hot reservoirs. Laughlin et al. further provide methods for tuning compression ratios of a compressor and expansion ratios of a turbine. These methods, however, provide performance penalties, complicated and costly mechanisms, reductions in performance, and limited in various ways.

SUMMARY

There exists a long-felt, unmet and growing need to provide means for storing electrical energy, particularly as the more renewable sources of energy are incorporated into utility grids and power systems. Embodiments of the present disclosure provide systems and methods for storing electrical energy. In preferred embodiments, the present disclosure provides a heat pump system, a heat engine system and a pumped heat energy storage ("PHES") system.

Embodiments of the present disclosure provide effective means for controlling the compression and expansion ratios of cylinders in a PHES system, thereby improving round-trip efficiency of the system. Systems, devices and methods of the present disclosure provide precise, continuous control to deliver working fluid at target temperatures corresponding to destination reservoirs. Systems of the present disclosure are simple and low cost at least when compared to existing PHES systems.

Systems, devices and embodiments of the present disclosure provide PHES systems that are compatible with advantageous sensible thermal storage materials which change in temperature as the system charges and discharges. Latent thermal storage materials, by contrast, operate at a single, fixed temperature associated with phase change. Advantages of sensible media include the fact that materials contemplated for use with embodiments of the present disclosure are more readily available in wider selection and lower cost than latent thermal storage media. The quantity of thermal energy stored can be higher because the sensible storage is not limited to the operating region of the phase transition (e.g., the heat of fusion). PHES systems of the present disclosure allow for varying reservoir temperatures using sensible thermal storage, provide high storage density, high round-trip efficiency, and low materials cost.

Embodiments of the present disclosure provide PHES systems that are operable to convert electrical energy to thermal energy, store thermal energy, and convert thermal energy to electrical energy. Embodiments of the present disclosure rely on thermodynamic cycles of working fluid to convert energy, transfer energy, store energy, and release energy on demand. It is known that renewable generation capacity connected to electric grids can be underutilized. When, for example, production is expected to be in excess of demand, renewable generation may be curtailed. As energy is a valuable resource throughout the world, there exists a need to store excess energy. Existing energy storage systems including battery systems, pumped-hydro systems, and known PHES systems suffer from various challenges and costs. Embodiments of the present disclosure provide an improved PHES system that is relatively low-cost, environmentally friendly, safe, and efficient.

In one embodiment, and by way of example and without limitation, a PHES system is provided that is rated to provide a maximum discharge of 1 MW of net continuous electrical power. The system is operable to continuously supply power to the grid (or other source) for a period of 24 hours. The system therefore comprises approximately 24 MWh of total electrical energy storage. The system comprises four identical and independent units, wherein each unit is rated for 250 kW/6,000 kWh.

The system comprises a first thermal reservoir or "hot reservoir" that comprises a container at atmospheric pressure containing approximately 675,000 kg of packed rock and/or gravel. Voids between gravel are filled with approximately 66,000 kg of a eutectic molten salt mixture with a melting point of approximately 127° C. and an allowable operating range of between approximately 150-485° C. Preferably, the reservoir is operated only between 150° C. at its minimum state-of-charge to 240° C. at its maximum state-of-charge. The thermal storage capacity is sized such that if the unit begins in a fully charged state and is allowed to discharge continuously at 250 kW, it would take 24 hours to become fully depleted. Rock/gravel is selected due to its low cost and solid state throughout the operating range. Molten salt is provided to fill in air gaps, thereby improving packing efficiency and thermal conductivity throughout the structure by wetting all external surfaces of the tubing and rock and allowing for thermal expansion of the tubing and rock. The salt has a specific heat of about twice that of rock.

Conduits are provided in the form of stainless-steel tubing to convey a working fluid (e.g. pressurized air) throughout the hot reservoir, where the working fluid exchanges heat with the rock and molten salt via conduction through its walls. The maximum gas pressure is 15.3 MPa, and the hot reservoir in total is approximately 310 cubic meters.

A second thermal reservoir or "cold reservoir" comprises ambient air and an air-to-air heat exchanger in which heat is drawn from ambient air during charge and delivered back during discharge. Ambient temperature fluctuates over time but is assumed for the purposes of this example to be at about 20° C.

The system further comprises eight dedicated compressor cylinders and eight dedicated expander cylinders, each with a bore of 20 cm and a stroke of 20 cm. The cylinders have a dead volume of 5 percent between the piston head and the valves, giving each cylinder a total maximum volume Vmax of 6.6 liters and a minimum volume Vmin of 0.3 liters.

The unit includes an auxiliary air pressure regulation system comprising an air compressor, storage tank, controllable regulators, and a safety pressure relief valve. The purpose of the regulation system is to control and maintain a desired base pressure of working fluid inside the unit. The regulation system initially supplies working fluid at a base pressure of 3.8 MPa. The unit is then started up with the storage media at ambient temperature and the salt in the solid state. It is pre-charged until the 150° C. minimum operating temperature of the hot reservoir is reached, melting the salt in the process. During this startup process the regulation system maintains an approximately constant base pressure.

The unit is charged such that the designated compressor cylinders receive working fluid from the cold reservoir at approximately 3.8 MPa and 20° C. and deliver working fluid to the hot reservoir at approximately 15.0 MPa and 160° C. This is above the initial reservoir temperature, allowing heat to transfer from the working fluid and conduit in which the fluid is provided to the rock and molten salt. The designated expansion cylinders draw in air at approximately 15.0 MPa and 150° C. and expand it to approximately 3.8 MPa and 13° C. This is cooler than the ambient air, so heat is drawn from the ambient air into the working fluid as it passes through the air-to-air heat exchanger. Charging the unit at this lowest state of charge requires 135 kW in total.

As the system continues to charge, the hot reservoir increases in temperature. As this occurs, the regulation system periodically removes some of the working fluid at a rate selected such that the base pressure reaches 2.0 MPa at maximum state-of-charge. The compression and expansion ratios are adjusted to ensure that working fluid (e.g. compressed air) is delivered to the hot reservoir at above reservoir temperature and that expanded air is delivered to the cold reservoir at below ambient temperature. Upon reaching the full state-of-charge, the compressors deliver the working fluid at approximately 15.3 MPa and 250° C., and the expanders deliver expanded working fluid at approximately 2.0 MPa and 9° C. At the maximum state-of-charge, the hot reservoir temperature is 240° C. and the final charge rate is 87 kW in total.

To discharge the system, working fluid is delivered to the hot reservoir at approximately 11.4 MPa and 207° C. and to the cold reservoir at approximately 2.0 MPa and 40° C. Thus, the working fluid temperatures are set to allow heat to flow from the reservoir into the working fluid on the hot side and from the working fluid to ambient air on the cold side. This corresponds to a discharge rate of 251 kW. As the system discharges, the regulation system delivers additional working fluid at a rate selected such that the base pressure is restored to the original 3.8 MPa at the lowest state-of-charge. The foregoing example is provided to illustrate one possible system in accordance with the present disclosure. Various details of the system may be varied without deviating from the scope and spirit of the present invention. Indeed, it is contemplated that systems of the present disclosure can be modified (including scaled up or down) based on requirements, available resources, available energy for storage, energy demands during discharge, and other factors.

Embodiments of the present disclosure provide methods and systems for pumping heat from a low temperature source to a high temperature source without energy storage. Embodiments of the present disclosure further provide for converting energy contained in a high temperature source without energy storage. For example, although certain embodiments of the present disclosure provide for thermal energy storage units such as heat reservoirs comprising salt, earth, water, etc., embodiments of the present disclosure are not limited to such systems. It is contemplated, for example, that certain methods and systems of the present disclosure are provided that can be operated as heat engines and/or heat pumps without a dedicated storage facility. In some embodiments, for example, a heat pump system and method of operating the same is provided wherein a compressor device is provided to communicate with a working fluid and transfer thermal energy between locations (e.g. between a dwelling or other structure and a subterranean location wherein the subterranean location comprises a heat sink). Such embodiments further comprise devices and methods for managing heat transfer as shown and described herein. For example, such embodiments are contemplated as comprising controlled valve timing, piston displacement, and/or piston speed to provide a controlled delivery of a working fluid at a certain temperature. For example, parameters of such systems can be controlled to prevent a working fluid from being delivered to a heat sink at an unacceptably high temperature based on a known ability of the heat sink to absorb thermal energy.

In one embodiment, a pumped heat energy storage system is provided that comprises a motor-generator unit and a plurality of cylinders having moveable pistons in communication with the motor-generator unit. Each of the moveable pistons are operable to receive and transmit energy to and from the motor-generator unit. A plurality of valves are associated with each of the plurality of cylinders, and each of the plurality of valves are operable to control a flow rate of a working fluid relative to a cylinder. The system comprise first and second thermal energy storage units. The working fluid is provided in communication with a fluid flow path that extends at least partially through the first and second thermal energy storage units. The system is operable to function as a heat engine wherein the working fluid performs work upon at least one moveable piston, and the system is operable to function as a heat pump wherein power is supplied to at least one moveable piston that performs work on the working fluid and wherein energy is converted and stored as thermal energy.

In another embodiment, a pumped heat energy storage system is provided that comprises a motor-generator unit and a compressor-expander unit in communication with the motor-generator unit. The term "compressor" and "compressor-expander" as used herein refers to various mechanical devices and components that are operable to impart force and work upon a fluid, as well as receive force and work from a fluid. Compressors and compressor-expander units include, but are not limited to, devices with cylinders and reciprocating pistons. The compressor is operable to impart and receive force to and from the motor-generator unit, and to expand a fluid by increasing specific volume and reducing temperature. A plurality of valves are associated with the compressor, and each of the plurality of valves are operable to control a flow rate of a working fluid relative to the compressor. A first thermal energy storage unit and a second thermal energy storage unit are provided. The working fluid is provided in communication with a fluid flow path, and the fluid flow path extends at least partially through the first and second thermal energy storage units. The system is operable to function as a heat engine wherein the working fluid performs work upon the compressor, and the system is operable to function as a heat pump wherein power is supplied to the compressor and the compressor performs work on the working fluid and wherein energy is converted and stored as thermal energy.

In various embodiments, methods of storing and releasing energy are provided. In one embodiment, a method of storing and releasing energy comprises providing a system with a motor-generator unit; a plurality of cylinders having moveable pistons in communication with the motor-generator unit, and wherein each of the moveable pistons are operable to receive and transmit energy to and from the motor-generator unit; a plurality of valves associated with each of the plurality of cylinders, wherein each of the plurality of valves are operable to control a flow rate of a working fluid relative to a cylinder; a first thermal energy storage unit; a second thermal energy storage unit; and wherein the working fluid is provided in communication with a fluid flow path that extends at least partially through the first and second thermal energy storage units. The method comprises steps of drawing the working fluid into a first cylinder with an inlet valve of the first cylinder open and an outlet valve of the first cylinder closed; allowing the working fluid to fill the first cylinder; closing the inlet valve and providing electrical power to the piston to compress the working fluid in the first cylinder and increase temperature and pressure of the working fluid; transferring the working fluid from the first cylinder to the first thermal energy storage unit and transferring thermal energy from the working fluid to the first thermal energy storage unit; transferring the working fluid from the first thermal energy storage unit to a second cylinder and expanding the working fluid within the second cylinder; transferring the expanded working fluid from the second cylinder to the second thermal energy storage unit; transferring thermal energy from the second thermal energy storage unit to the working fluid; and transferring the working fluid from the second thermal energy storage unit to the first cylinder. The system is capable of releasing energy stored by the aforementioned method by performing the above process steps in a reverse or inverse manner.

In some embodiments, systems, methods and devices are provided that operable to function as a heat pump. For example, in some embodiments a compressor or compressor-expander device is provided with valves and control features as shown and described herein, and the system is operable to "pump" or convey heat. Such embodiments include but are not limited to a heat transfer system that provides thermal energy (or converts energy to thermal energy) within a working fluid and transfers the working fluid and the thermal energy to a heat sink (e.g. ground). Piston position, valve timing, and a temperature of the working fluid leaving the compressor or compress-expander device is controlled as explained herein to optimize system performance.

The above-described embodiments, objectives, and configurations are neither complete nor exhaustive. As will be appreciated, other embodiments of the invention are possible using, alone or in combination, one or more of the features set forth above or described in detail below.

The phrases "at least one," "one or more," and "and/or," as used herein, are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

The term "a" or "an" entity, as used herein, refers to one or more of that entity. As such, the terms "a" (or "an"), "one or more," and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

BRIEF DESCRIPTION OF THE DRAWINGS

The accompanying drawings, which are incorporated in and constitute a part of the specification, illustrate embodiments of the invention and together with the Summary given above and the Detailed Description of the drawings given below, serve to explain the principles of these embodiments. In certain instances, details that are not necessary for an understanding of the invention or that render other details difficult to perceive may have been omitted. It should be understood, of course, that the invention is not necessarily limited to the particular embodiments illustrated herein. Additionally, it should be understood that the drawings are not necessarily to scale.

DETAILED DESCRIPTION

Embodiments of the present disclosure have significant benefits across a broad spectrum of endeavors. It is the Applicant's intent that this specification be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, may be modified in numerous ways within the scope and spirit of the invention.

Figure 1:
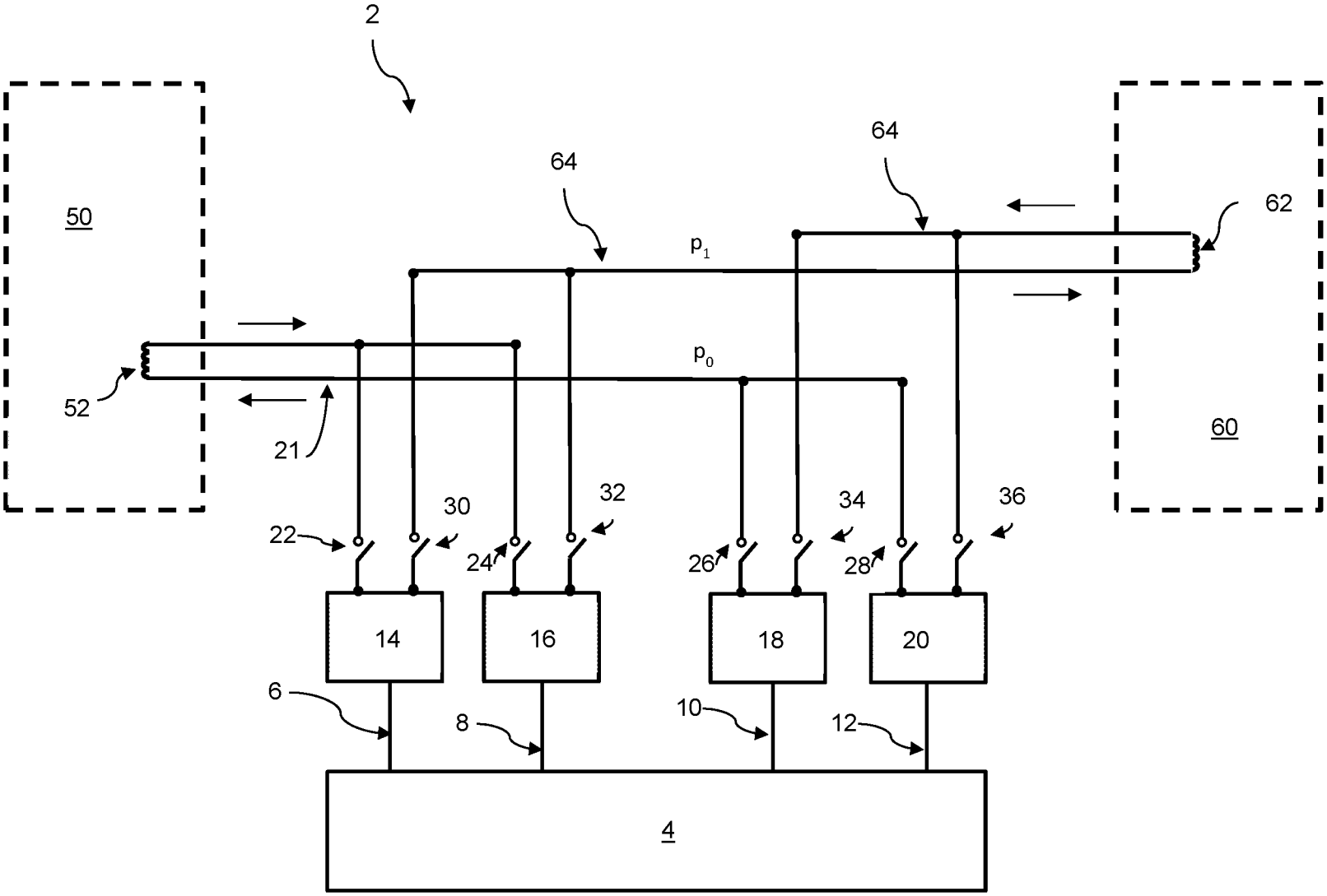
FIG. 1 is a schematic diagram of a PHES system according to one embodiment of the present disclosure.

FIG. 1 is a schematic of a PHES system 2 according to one embodiment of the present disclosure. As shown, a motor-generator 4 is provided. The motor-generator 4 is operable to receive electrical energy in the form of current and convert the electrical energy to mechanical and kinetic energy by actuating at least one of a plurality of piston rods 6, 8, 10, 12 (i.e. the motor-generator is operable to function as an electric motor). Additionally, the motor-generator 4 is operable to receive mechanical and kinetic energy as will be shown and described herein and convert the mechanical and kinetic energy to electrical power (i.e. the motor-generator is operable to function as a generator unit).

The plurality of piston rods 6, 8, 10, 12 are in communication with a plurality of piston heads provided within cylinders 14, 16, 18, 20. The cylinders comprise variable volumes of working fluid (e.g. air or other gas) for compression and expansion. In some embodiments, the cylinders 14, 16, 18, 20 comprise one or more manifolds that provide one or more fluid flow paths between the volumes of the cylinders and the valves. In various embodiments, it is contemplated that a working fluid is provided in communication with the cylinders 14, 16, 18, 20. In certain embodiments, a working fluid is provided as air. It will be recognized, however, that the working fluid can comprise various different gases based on availability and system requirements. Preferably, the working fluid comprises an inert gas with desired heat transfer properties and which is not highly volatile or combustible, particularly when compressed and/or heated.

As shown in FIG. 1, each of the cylinders 14, 16, 18, 20 are in fluid communication with inlet valves 22, 24, 34, 36, and outlet valves 30, 32, 26, 28. In operation, the embodiment of FIG. 1 comprises a first piston and cylinder 14 that draws a quantity of fluid into the cylinder 14 with the inlet valve 22 open and the outlet valve 30 closed.

A cold reservoir 50 is provided within the system. The cold reservoir 50 in various embodiments comprises a mass of material that is operable to receive and provide thermal energy. This material may include, but is not limited to soil, gravel, rock, oil, water/ice, ambient air and/or ambient earth. A conduit or similar fluid flow path 21 is provided between the cold reservoir 50 and at least one of the cylinders. Typically at the inlet valves 22, 24, a working fluid (e.g. air) is approximately at a temperature of a cold reservoir 50 of the system, wherein the fluid has been subjected to the cold reservoir 50 for a period of time and/or has passed through the storage medium via a heat exchanger 52 provided within the cold reservoir 50. Upon exiting the cold reservoir 50 and entering the first cylinder 14 with inlet valve 22 open and outlet valve 30 closed, the fluid is at a low pressure $p_0$. The fluid is drawn into cylinder 14 by moving the piston head and rod 6 and increasing the effective volume of the cylinder 14. Once a sufficient or desired amount of fluid has entered the first cylinder 14, a compression process begins. The compression process comprises closing the inlet valve 22 and reversing the motion of the rod 6. Electrical power is supplied to the rod 6 and the fluid in the cylinder 14 is compressed until the temperature of the fluid within the cylinder 14 reaches a desired temperature. The desired temperature to be achieved during this compression is a temperature TH+ that is slightly above a bulk or average temperature TH of a hot reservoir 60 associated with the system, and the pressure of the fluid leaving the cylinder(s) and supplied to the hot reservoir is at an elevated pressure $p_1$, and wherein $p_1$ is greater than $p_0$. The hot reservoir comprises a mass of material. The material may include, but is not limited to rock, gravel, and/or salt(s).

Once the desired pressure $p_1$ and temperature TH+ are achieved by actuating the piston(s) and compressing the fluid housed within a cylinder, an outlet valve 30 opens. Continued movement of the rod 6 and piston expels the fluid at TH+ and $p_1$ into a high-pressure conduit 64 through which the fluid is conveyed to the hot reservoir 60. The hot reservoir 60 comprises one more heat exchangers 62 through which fluid is allowed to pass. Heat exchangers for use with various embodiments of the present disclosure provided within cold or hot reservoirs are not limited to any particular type or arrangement of heat exchanger. In various embodiments, a heat exchanger within a reservoir of the present disclosure comprises a coil-type heat exchanger to increase surface area contact with a medium of the reservoir.

The hot reservoir 60 comprises a heat exchanger and a thermal storage medium. The medium may comprise various arrangement and materials including, but not limited to, rock, gravel, oil and/or molten salt. The heat exchanger enables and enhances the working fluid's ability to exchange heat energy with the medium. The working fluid exits the hot reservoir 60 at a temperature that is approximately equal to a bulk temperature TH of the hot reservoir 60. Accordingly, the temperature of the working fluid leaves the hot reservoir 60 at a lower temperature than the entrance temperature TH+ of the working fluid into the hot reservoir 60. In this manner, electrical energy supplied to a piston rod 6 (for example) is converted to thermal energy by compressing a gas within a cylinder, and that energy is transferred from the gas to a thermal reservoir 60.

Upon exiting the hot reservoir 60, the working fluid is provided through a channel or conduit 64 and drawn into a cylinder 18 with the cylinder's inlet valve 34 open and the outlet valve 26 closed. Conduits 21, 64 and other features of systems of the present disclosure are contemplated as being provided with various insulation and insulating features. Various known insulating materials and systems are contemplated for use with embodiments and features of the present disclosure. At a predetermined point along the piston's travel, the inlet valve 34 closes and the cylinder's 18 volume continues to expand while keeping the outlet valve 26 closed, thus causing the working fluid to expand within the volume of the cylinder 18. This expansion lowers the temperature of the gas to a temperature TC− slightly below TC, the bulk or average temperature of the cold reservoir 50. A proper amount of expansion must be provided and achieved in order to expand and cool the fluid to the appropriate temperature. In various embodiments, this is accomplished by calibration and control of valve 26 and valve 34 relative to the linear position of the piston head within the cylinder 18, as shown and described in more detail herein. Once the desired temperature TC− of the working fluid within the cylinder 18 is achieved, the outlet valve 26 opens and the piston associated with the cylinder 18 expels the expanded working fluid into the low-pressure conduit 21. Electrical power is provided to the piston/cylinder 18 to expel the expanded fluid at this stage.

The working fluid flows through the low-pressure conduit 21 to the cold reservoir 50 and the heat exchanger 52. The heat exchanger 52 provides sufficient area to enable the working fluid to receive thermal energy from the medium within the cold reservoir 50, and the working fluid that was expanded in the cylinder 18 and cooled to TC− ultimately exits the cold reservoir 50 at approximately TC. In this manner, the working fluid receives thermal energy from the cold reservoir 50. As shown and described, the expanding working fluid in the expansion cylinder 18 in this method performs work on the cylinder. Accordingly, in at least some embodiments of the present disclosure, work is performed by the working fluid on the motor-generator unit even during a charge operation (and wherein total net work is input to the system 2).

In various processes of the present disclosure, and with reference to a particular cylinder, work is performed at any given moment by a piston on a working fluid or by a working fluid on a piston. For example, and with reference to FIG. 4, during a compression process (e.g. h-b-j-i) work is performed by the piston on a working fluid in operations represented by b-j and j-i; and work is performed on a piston by the working fluid in operations represented by h-b and i-h. However, total net work in this compression process is characterized by work being performed on the working fluid. Similarly, in an expansion process (e.g. i-j-b-h-i), work is performed on the working fluid by a piston in operations represented by b-h and h-i; while work is performed on the piston by the fluid in operations represented by i-j and j-b. Total net work in this expansion process is performed by working fluid on the piston.

In various embodiments, the cold reservoir 50 comprises a physical sensible or latent thermal storage medium. It will be recognized that in embodiments which comprise latent media, the temperature of the reservoir having a latent media may not change even though energy has been exchanged. In some embodiments, the cold reservoir 50 is contemplated as comprising at least one of ambient air, ground, and a body of water. In such embodiments, the temperature of the medium within the cold reservoir 50 will remain substantially unchanged during operation of the system based on the significant mass and volume of the reservoir 50. The heat exchanger 52 is contemplated as comprising fans, fins, pumps and similar devices to increase heat transfer between a working fluid and the reservoir 50. An advantage of using ambient air in systems according to the present disclosure is that such a media is cost effective. Other materials and media, including those which operate within a more stable temperature range, are contemplated.

A second cylinder 16 of the system 2 and its associated rod 8 and valves 24, 32 operate in a similar manner as that described with respect to the first cylinder 14. In embodiments that comprise a linear motor-generator unit 4, the cylinders 14, 16 are contemplated as operating in-phase. In embodiments that comprise a crankshaft arrangement associated with the motor-generator unit 4, the cylinders are contemplated as operating at a different phase angle. A fourth cylinder 20 and its associated rod 12 and valves 28, 36 operate in substantially the same manner as the third cylinder 18 but may operate at a different phase angle. Although a motor-generator unit 4 is shown in FIG. 1 as comprising four cylinders and a related flow path for working fluid, it will be recognized that systems of the present disclosure may be scaled up or down, that motor-generator units 4 may connect to any number of cylinders, and that additional or supplemental motor-generator units (of the same or different construction) can be provided within a system 2.

In the foregoing description, a system is provided wherein work is done by pistons on the working fluid for compression and expulsion of working fluid, while work is done by the working fluid on the pistons during expansion and draw of working fluid. Overall, net work is performed on the working fluid during a complete cycle of the working fluid while in the aforementioned charging mode of operation of the system 2. This charging mode corresponds to a net energy input into the system 2 where it may be stored in the system of FIG. 1 for later use (e.g. when demand increases) in a discharge mode of operation.

During discharge, a first cylinder 14 compresses a working fluid and delivers the compressed, heated working fluid to the high-pressure conduit 64. In this mode of operation, however, the target temperature of the working fluid to be obtained within the cylinder 14 is slightly lower than TH. As the pressurized working fluid passes through the hot reservoir 60 in the discharge mode, the lower temperature allows the working fluid to receive thermal energy from the hot reservoir 60 that was previously provided to and stored in the hot reservoir 60 during a charge operation. A third cylinder 18 also serves to expand the working fluid as previously described and delivers the fluid to the low-pressure conduit 21. However, the target discharge temperature from the third cylinder 18 is slightly above TC. As the low-pressure working fluid passes through the cold reservoir 50, the working fluid releases thermal energy to the cold reservoir 50 via heat exchanger 52. Net work is performed on the pistons of the cylinders by the working fluid during the discharge mode of operation. During a charge operation, net work is performed by the motor generator unit 4 on the piston rods 6, 8, 10, 12 and in turn on the pistons and the working fluid. Within a 360-degree rotational cycle of any piston, there is work done in both directions and energy is constantly moving in and out of the system and grid. Over time, however, the integral of this energy is viewed as an input or an output. In various embodiments, power fluctuations are managed by the provision of at least one of a battery, a flywheel and a capacitor.

The system 2 of FIG. 1 comprises one embodiment of the present disclosure having four cylinders and associated rods and valves. It will be recognized, however, that the present disclosure and inventions described herein are not limited to the arrangement shown in FIG. 1. The system 2 of FIG. 1 is provided for illustrative purposes and various different alternative arrangement and structures are contemplated as being provided within the scope and spirit of the present invention. For example, systems with alternative numbers and arrangements of cylinders, connecting rods and valve sets from that shown in FIG. 1 are contemplated. Additionally, it will be recognized that the system 2 of FIG. 1 is provided to convert electrical energy to thermal energy, and various alternatives are possible. It is contemplated, for example, that two or more turbines are provided as means for compressing and expanding a gas in lieu of pistons.

Figure 2:
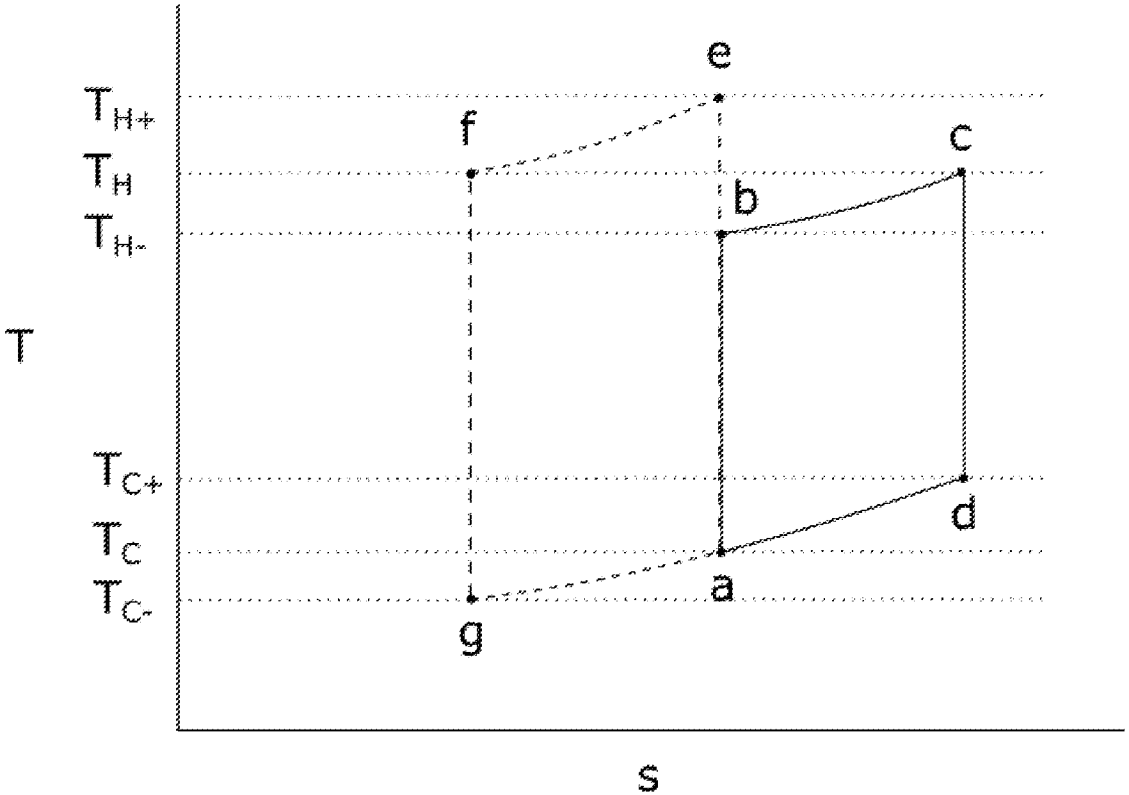
FIG. 2 is a temperature-entropy plot illustrating principles of certain embodiments of the present disclosure.

FIG. 2 is a plot showing changes in temperature and entropy of a working fluid. During a charge mode of operation including, for example, that shown and described with respect to the system of FIG. 1, a working fluid is compressed from a point a of initial temperature TC to a point e at a temperature TH+ that is slightly above a temperature of a hot reservoir TH. Heat is then removed from the working fluid (e.g. in the hot reservoir 60), reducing the temperature and entropy of the working fluid. The working fluid properties move from point e to f at approximately TH. During expansion, the working fluid temperature decreases from TH to a temperature TC− (point g) that is slightly below the cold reservoir temperature TC. The working fluid then draws thermal energy from the cold reservoir until the temperature of the working fluid reaches TC at point a. The charge mode of operation can therefore be characterized as having a path a-e-f-g-a on the Temperature-Entropy diagram of FIG. 2.

The selection of target temperature TH+ is dependent upon operating objectives as follows. The rate at which heat flows from the working fluid into the hot reservoir 60 via the heat exchanger 62 is related to the difference between TH+ and TH. The greater the temperature difference, the greater the heat flow. At the same time, a high temperature difference means that additional work is required to reach the high temperature. Thus, there is a trade-off between the rate of power transfer and the round-trip efficiency of the system. Similar trade-offs are found when selecting temperatures TC−, TH−, and TC+.

During discharge, the working fluid proceeds along a path that can be described as a-b-c-d-a in FIG. 2. The target temperature of TH− at b and TC+ at d are employed to ensure that thermal energy flows in the directed direction in the reservoirs 50, 60 and at the desired rates. As shown, target temperatures of the working fluid during a charge mode of operation are different than target temperatures during discharge. Methods and systems for establishing and delivering the working fluid at desired target temperatures is described in more detail herein.

Figure 3:
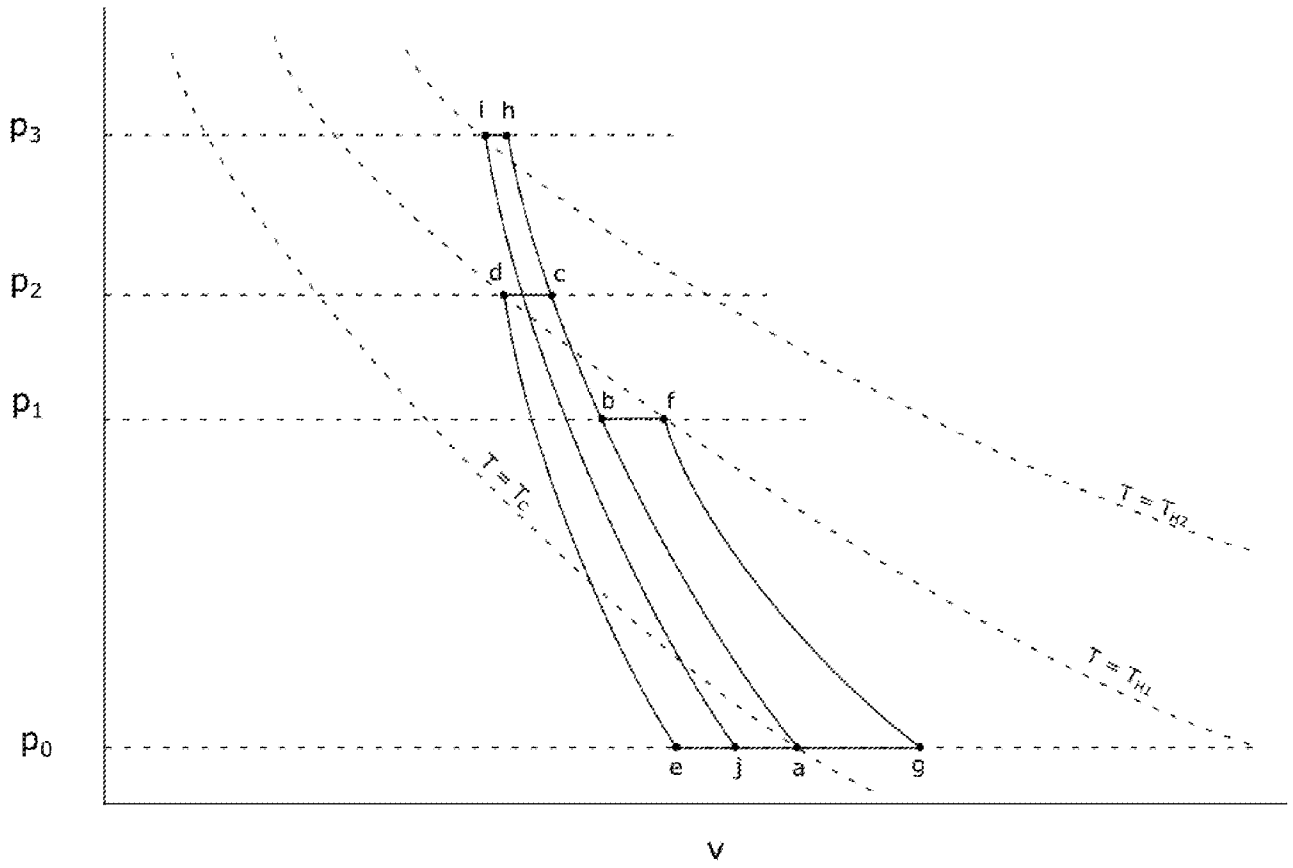
FIG. 3 is a pressure-volume plot illustrating principles of certain embodiments of the present disclosure.

FIG. 3 is a plot of pressure and specific volume of a working fluid in a system according to certain embodiments of the present disclosure. A change in pressure and specific volume of the working fluid is illustrated, as well as lines of constant temperature at TC, TH1 and TH2. Path a-c-d-e-a illustrates a charging process according to certain embodiments of the present disclosure and at a given state of charge. Along this path, the working fluid is compressed from $p_0$ to $p_2$ and to a temperature slightly above TH1. As the working fluid transfers thermal energy to the hot reservoir (for example) while maintaining constant pressure, the working fluid temperature is reduced to TH1. The working fluid is then expanded back to $p_0$ at a temperature slightly below TC, and the working fluid is thereafter heated at constant pressure back to a.

A discharge path or process is illustrated in FIG. 3 as path a-b-f-g-a wherein compression delivers the working fluid at a temperature slightly below TH1. Preferred embodiments of the present disclosure provide systems and methods wherein the desired target ending pressure and specific volume during charge are different than the target ending pressure and specific volume during discharge. These differences are represented in FIG. 3 as the distance between $p_2$ (points c and d) and $p_1$ (points b and f), wherein the working fluid is brought to a pressure $p_2$ during a charging process, and the working fluid is brought to a lesser pressure $p_1$ during a discharging process.

In certain embodiments, it is contemplated that the temperature of the storage media within a cold and/or hot reservoir will change as the state-of-charge changes. It is contemplated that sensible storage media within reservoirs are of a finite mass for practical reasons and will experience some change in temperature during operations shown and described herein. Further, it is contemplated that both sensible and latent storage media will require different target temperatures for charging and discharging for reasons described above. Accordingly, it is an object of the present disclosure to provide for control of the outlet temperature and pressure of working fluid from cylinders. With reference again to FIG. 3, if the hot reservoir is at TH1 during one state of charge, continued charging will cause the hot reservoir 60 to rise to an elevated temperature TH2. Additional charging at this higher state-of-charge will require that compression reach higher pressures ($p_3$ in FIG. 3, for example), and lower specific volumes than at the earlier state-of-charge. The present disclosure therefore provides the means to modulate the target temperatures and pressures through the timing of control valve operation as described above.

Figure 4:
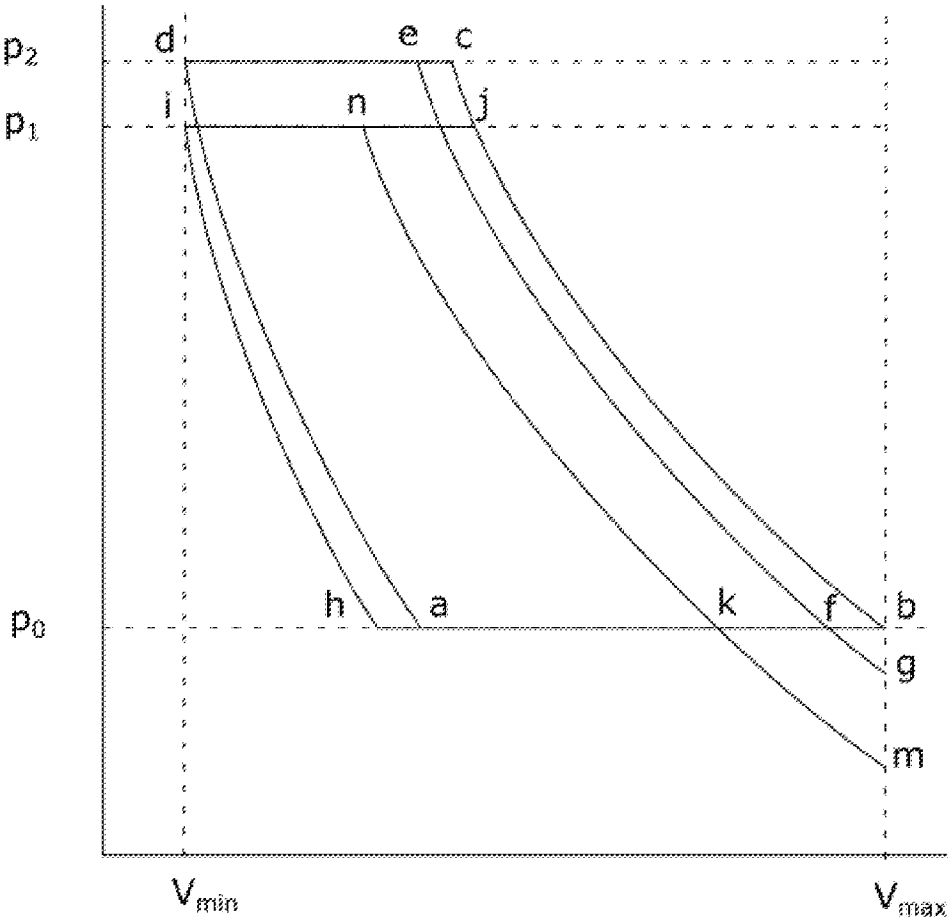
FIG. 4 is a pressure-volume diagram of a working fluid in accordance with methods and systems of embodiments of the present disclosure.

Methods and systems of the present disclosure provide that outlet working fluid properties of temperature, pressure and specific volume are controlled in adiabatic compression and expansion processes. Certain embodiments of the present disclosure provide for this control by controlling the timing of valve openings and closings relative to piston position. As shown in FIG. 4, physical limits of a piston are presented by the maximum volume Vmax and minimum volume Vmin of a cylinder. Compression of a working fluid from $p_0$ to $p_1$ is illustrated as path h-b-j-i-h, which represents compression during either a charge or discharge mode. Working fluid is drawn at $p_0$ into a cylinder between h and b with the inlet valve open. The inlet valve is then closed and the piston compresses the working fluid to point j whereupon the outlet valve opens. The working fluid is then expelled at $p_1$ to point i where the piston reverses and the outlet valve closes. The piston returns to point h, expanding a small volume of residual working fluid from $p_1$ to $p_0$. At this point, the inlet valve opens and the process can repeat.

As is also shown in FIG. 4, the cylinder is capable of compressing the working fluid from $p_0$ to $p_2$ along path a-b-c-d-a. Along this path the piston motion is substantially the same as path h-b-j-i-h but the valves are controlled to open and close at different piston positions. Instead of opening the outlet valve at j (for example), the working fluid is compressed further and the outlet valve is instead opened at c (with elevated pressure $p_2$). Similarly, instead of opening the inlet valve at h, the inlet valve is opened at a. This action results in the fluid outlet pressure of $p_2$. By varying the piston position at which the valve(s) open and close, outlet pressures and specific volumes may be produced within the constraints imposed by Vmax and Vmin (as it is acknowledged and assumed that a cylinder connected to the motor-generator 4 comprises a fixed volume). The outlet temperature of the working fluid from the cylinder(s) are also controlled since the relationship between pressure, specific volume and temperature are known for adiabatic processes.

The aforementioned methods are also contemplated for use with expansion processes. Specifically, path d-c-b-a-d may be employed to expand a working fluid from $p_2$ to $p_0$. It is also contemplated that working fluid entering a cylinder at $p_1$ is subjected to path i-j-b-h-i to expand a fluid from $p_1$ to $p_0$. In various embodiments, control of inlet and outlet valves of a cylinder is achieved by at least one of electrical and mechanical control. For example, in some embodiments, solenoid valves are provided and are operable to actuate inlet and/or outlet valves in response to the presence or absence of electrical current flowing through the solenoid. Systems and methods of the present disclosure provide valve timing and control based on piston position information received from a piston position sensor and/or on measured working fluid properties within and/or without a cylinder (e.g. temperature and pressure).

In some embodiments, valve control methods are provided that use piston position sensing as an input to the control unit, as illustrated in the following example. If a system is in charge mode and the bulk temperature of the hot cylinder is increasing, it is necessary to increase correspondingly the target temperature at the outlet of the compressor cylinders. This, in turn, requires an increase in pressure in the high-pressure conduit. The pressure is variable, and depends upon the rate of working fluid mass entering the conduit from the compressors and the rate of working fluid mass exiting the conduit from the expanders. In the case of an expansion cylinder, the path i-n-k-m-k-h-i in FIG. 4 represents the behavior of the expansion cylinders. In this case the mass of working fluid removed from the conduit per piston cycle of the expansion cylinder depends upon the inlet temperature, inlet pressure, and inlet valve opening position n. By moving valve position n to the left in FIG. 4, i.e., to a point allowing a smaller volume of inlet working fluid, less working fluid would be removed, and this will cause the conduit pressure to rise. By moving valve position n to the right, more working fluid would be removed, and this will cause the conduit pressure to fall. Similar control may be performed for the expansion cylinder exit valve and the inlet and exit valves of the compressor cylinders. In such cases, the control system may use as inputs sensor readings of piston position, hot and/or cold reservoir temperature, and cylinder outlet temperatures. The control system may thereby modulate the piston position at which valves open and close to achieve the desired outlet temperatures.

In further embodiments, the foregoing example is provided and instead of adjusting valve operation as a function of piston position within the cylinder, valve operation is adjusted as a function of phase angle of a motor winding current. Current sent to motor windings is periodic, and the phase angle ranges from zero degrees to 360 degrees, after which the periodic current waveform repeats. Phase angle is either known (in the case of electronically controlled variable speed drives) or readily measured (in the case of conventional motors driven directly from grid frequency).

Various embodiments of the present disclosure provide methods and systems for controlling various parameters of a system. For example, in some embodiments, the mass flow rate of the working fluid are controlled to modulate system power level. In some embodiments, path h-b-j-i-h is used in either charge or discharge mode to compress a volume of working fluid (e.g. distance between h and b) from a first pressure $p_0$ to a second pressure $p_1$. A smaller volume of working fluid can be compressed by path h-k-m-k-n-i-h. This volume is presented by the distance between h and k. Over successive positive displacement cycles, this would result in a lower mass flow rate during compression. Mass flow rate during compression is contemplated as being increased or decreased by controlling the timing of the inlet and outlet valves relative to the piston position. Various mass flow rates can be produced within the physical constraints of the size or volume of the cylinder(s). The partial path k-m-k begins and ends at the same thermodynamic state, and the work of expansion equals the work of compression over this path. Accordingly, no net work is performed over k-m-k.

Control and timing methods of the present disclosure are contemplated as being employed in an expansion process in either charge or discharge mode. For example, path i-j-b-h-i may be used for maximum inlet volume at $p_1$ represent by the distance i-j. In this case, the inlet valve of a cylinder remains open until point j is reached whereupon the inlet valve is closed. Additionally, however, it is contemplated that the inlet valve is closed at point n, resulting in a path of i-n-k-m-k-h-i in which a smaller volume of gas (i-n) is expanded. By selectively controlling the positions for valve opening and closing, mass flow rate during expansion is controlled.

The same methods are contemplated as being employed as pressure levels change. For example, when expanding as from $p_2$ to $p_0$, either path d-c-b-a-d or path d-e-f-g-f-a-d is used depending on target mass flow rate. Using the aforementioned methods and systems, total mass flow rate through cylinders used to compress the working fluid is set equal (or is capable of being set equal) to the total mass flow rate through cylinders used to expand the working fluid. Over a short period of time, before the reservoir temperatures are allowed to significantly increase or decrease, this enables working fluid to release heat at constant or near-constant pressure. Additionally, compression and expansion ratios are changed in a coordinated fashion by changing mass flow while ensuring that total mass flow of compression equals total mass flow of expansion. By doing so, the thermodynamic states along the cycle remain the same, and mass flow rates can be made to increase or decrease. Mechanical and electrical power levels change to correspond with the mass flow rate.

By controlling mass flow rate, the electrical net work delivered to the system during charge and electrical net work delivered from the system during discharge are controlled. This power control can be used to modulate power levels. The same method and system can be used to maintain power levels at a constant rate as the reservoir temperature differential changes.

Various embodiments of the present disclosure contemplate controlling the power output of a PHES system though motion control. Specifically, various embodiments contemplate that a motor-generator device (4 in FIG. 1, for example) comprises an electronic motion control unit to modulate a frequency (RPMs) of the reciprocating piston motion in embodiments that comprise a reciprocating piston device. When piston frequency is increased or decreased, a mass flow rate of the working fluid will correspondingly increase or decrease. Accordingly, the power output and input are contemplated as being controlled and adjusted by adjusting piston speed during the discharging and charging modes, respectively.

In various methods and systems of the present disclosure, the motor-generator system comprises an electronic motion control unit to modulate piston stroke. This control unit is operable to decrease frictional losses when the full range of piston motion is not needed. For example, one process used for compression comprises path h-k-m-k-n-i-h in FIG. 4. This path is contemplated for use when the piston is allowed to travel its full range between Vmin and Vmax (i.e. a full piston stroke). Such motion is observed when a rotational motor is used in combination with conventional crank shaft to produce reciprocating motion of the pistons. However, a free piston may also be used in combination with a linear motor and the electronic motion control unit to limit the range between Vmin and Vk (FIG. 4). This capability is employed in certain embodiments to produce gas compression path h-k-n-i-h. In this case, the partial pathway of k-m-k is avoided. This reduced the total piston travel distance and travel time, enabling higher overall system power rates and production. This also reduced frictional loss between pistons and cylinder walls as the pistons are not traveling unnecessary distances, thus increasing system efficiency. Similar use of free pistons under motion control is contemplated for use in gas expansion.

Various embodiments of the present disclosure contemplate cylinders that are provided to perform compression and/or expansion of a working fluid. For example, in the embodiment shown in FIG. 1, a first cylinder 14 is coupled to valves 22, 30 such that the first cylinder 14 is used in compression while a third cylinder 18 is coupled to valves 26, 34 for use in expansion. However, more than two valves are contemplated as being provided with a cylinder, enabling a cylinder to perform both compression and expansion depending on valve operation. Valve operation may be controlled with a control unit in various embodiments. For example, the valves 26, 34 associated with the third cylinder 18 are contemplated as being coupled instead with the first cylinder 14 in addition to the first inlet and outlet valves 22, 30 being coupled to the cylinder 14. The cylinder thus configured is operable to use valves 22, 30 for compression while keeping valves 26, 34 closed, while at a later time when so desired to use valves 26, 34 for expansion while keeping the first set of valves 22, 30 closed. Any number of cylinders may thus be configured as either dedicated compression cylinders, dedicated expansion cylinders, or dual-purpose compression and expansion cylinders.

Dual-purpose cylinders provide an additional means to control mass flow rates within a system. For example, in discharge, the temperature of a hot storage reservoir may increase to the point where the physical cylinder limits of the expansion cylinders would otherwise limit the maximum amount of flow. This is shown in FIG. 4 where the expansion cylinder is operable to cycle through path d-e-f-g-f-a-d and where points e, f, and g may be moved to reflect the state-of-charge. A maximum flow rate for the cylinder corresponds to path d-c-b-a-d. If, for example, the cylinder(s) used for expansion are limited to fixed number of dedicated cylinders, mass flow in expansion would be limited.

In various embodiments of the present disclosure, it is contemplated that cylinders are activated and/or deactivated as a means to control power. Thus, the number of cylinders available for compression and the number of cylinders available for expansion is variable. By increasing the number of active cylinders, the mass flow may be increased and by decreasing the number of active cylinders, the mass flow may be decreased. For example, a system having 10 cylinders may be operated with any number between one and 10 active at any time. When no cylinders are active, the system is idle, neither charging nor discharging. Activated cylinders are controlled using methods described previously. Cylinders may be deactivated by keeping all inlet valves closed, all outlet valves closed, or all valves closed.

By activating an inactive cylinder a mass flow limit can be overcome and increased as an additional cylinder volume is made available. This provides a means to increase the expansion mass flow by increasing the number of cylinders available for expanding the working fluid. Methods and systems of the present disclosure thus provide additional means to increase or decrease mass flow in expansion and compression processing beyond what is available with a fixed number of dedicated cylinders.

A further benefit of embodiments of the present disclosure comprising dual-purpose cylinders is provided wherein increased energy storage capacity is achieved. Specifically, energy storage capacity of a system is increased by enabling cylinders to work with increased hot storage reservoir temperatures. When the number of expansion cylinders is fixed, the maximum mass flow is limited based on various considerations. If the number of expansion cylinders is increased, however, an operating path can change to relieve the contribution of each cylinder. As shown in FIG. 4, an intake volume otherwise limited to Vc-Vd may effectively become Ve-Vd. Each cylinder may thus achieve the same mass flow without being limited in volumetric capacity. The increase in available cylinder capacity additionally allows a cylinder to support higher pressures and higher temperatures. By increasing the number of expansion cylinders, however, the number of cylinders available for compression at a given moment decreases. Accordingly, in some embodiments, increasing storage capacity deceases power levels.

In various embodiments, a system control unit is operable to dynamically select the number of cylinders used for compression and expansion. The selection may depend, for example, on the charge/discharge mode and the state-of-charge of the system. For example, in an embodiment comprising 100 cylinders and at the beginning of a discharge operation, 75 cylinders could be used for expansion and 25 cylinders could used for compression. As the state-of-charge decreases during the discharge operation, 50 cylinders could be used of expansion and compression each.

Various embodiments of the present disclosure comprise a working fluid flowing in a single direction in two conduits (21 and 64 of FIG. 1, for example) regardless of whether the system is charging or discharging. Flow direction in such embodiments is maintained by a cylinder 14 drawing low pressure fluid though a valve 22 and expelling compressed fluid through the outlet valve 30. Flow direction is maintained by a third cylinder 18 drawing high pressure fluid through a valve 34 and expelling expanded fluid through outlet valve 26. It is also contemplated, however, that fluid flow direction can be altered without changing the valve connections. For example, a cylinder 14 is operable to draw high pressure fluid from a valve 30 and expel the expanded fluid through an additional valve 22. The third cylinder 18 is operable to draw low pressure fluid from a valve 26 and expel compressed fluid from another valve 34.

An advantage of the aforementioned valve and flow-reversal capability is higher round-trip efficiency based on potential uneven heating in the reservoirs. While this disclosure provides for approximately constant temperatures throughout the storage media (either TC or TH) a flow of thermal energy within the reservoirs will typically lead to small thermal gradients within the reservoir and the system generally. For example, during charge, the working fluid at the inlet to the hot reservoir is at TH+. As the fluid passes through a medium of a reservoir, it releases or deposits heat and exits at TH. Thus, the thermal medium near the inlet is contemplated as being slightly higher in temperature than it is at the outlet. If the working fluid flowed through the reservoir in the same direction during discharge, and if it were allowed to reach effectively the bulk medium temperature at its exit, the gas would exit at approximately TH. However, if the flow were reversed during discharge, the thermal medium in the vicinity of the exit would be at TH+. This would allow the working fluid to reach a higher temperature than before prior to expansion. Hence, more work is retrievable during expansions, increasing the round-trip efficiency. A similar efficiency benefit is recognized in the cold reservoir.

In various embodiments, valves used for compression 22, 30, 24, 32 comprise one-way check valves installed corresponding to the flow direction in FIG. 1. In such embodiments, these valves do not require external energization and open and close passively in response to pressure differential between valve inlet and outlet. When pressurizing a working fluid between $p_0$ and $p_1$ in FIG. 4, for example, an inlet check valve 22 permits the flow of fluid into the cylinder between h and b and closes as pressure increases in the cylinder as the fluid moves along path b-j-i-h. An outlet check valve 30 permits the fluid to exit the cylinder 14 between j and i, and closes as pressure drops below $p_1$ along the path i-h-b-j. The inlet valve 24 operates similarly to the adjacent inlet valve 22 and outlet valve 32 operates in a similar manner as the related outlet valve 30.

In various embodiments, check valves are provided. Check valves are advantageous for compression, whether for charging or discharging, because they do not require control or activation energy, and because they require fewer parts and are less expensive than controlled valves.

In some embodiments, dual purpose cylinders are contemplated as comprising both check valves and controlled valves. In the example above, valves 26 and 34 are coupled with a cylinder 14 in addition to the original valves 22, 30. In this case, valves 22 and 30 are provided as check valves used for compression and valves 26 and 34 are controlled valves used for expansion.

Electrical energy may be an alternating current source or a direct current source. The motor-generator system 4 of various embodiments of the present disclosure comprises either linear motor-generators or conventional rotational motor-generators. Linear motor-generators are contemplated as being magnetically coupled to connecting rods 6, 8, 10, 12. Rotational motor-generators are contemplated as being kinematically coupled to connecting rods 6, 8, 10, 12 through mechanical means such as drive shafts, cranks, and bearings.

Over a complete piston cycle, mechanical power flows in both directions through the connecting rods 6, 8, 10, 12. This is true of both charge and discharge operating modes and for cylinders used for either compression or expansion. Thus, the total mechanical energy to or from the motor generator unit 4 fluctuates within the time frame of a piston cycle. In some embodiments, the motor-generator system is therefore contemplated as comprising short term energy storage as a buffer to ensure that the overall consumption or supply of electrical power is relatively constant. To accomplish this, the motor-generator system of various embodiments comprises mechanical inertia, such as a flywheel, or short-term electrical storage, such as a capacitor or battery. In either case, the amount of energy stored is negligible compared to the total system energy storage capacity and is merely used for smoothing system input and output.

Although the foregoing text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity so as to not confuse the reader, and it is not intended that such claim term by limited, by implication or otherwise, to that single meaning.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. It is to be expressly understood that such modifications and alterations are within the scope and spirit of the present invention.

What is claimed is:

1. A pumped heat system comprising:

a motor-generator unit;

a plurality of cylinders having moveable pistons in communication with the motor-generator unit, and wherein each of the moveable pistons are operable to receive and transmit energy to and from the motor-generator unit;

a plurality of valves associated with each of the plurality of cylinders, wherein the plurality of valves are operable to control a flow rate of a working fluid relative to the plurality of cylinders;

a first thermal energy reservoir comprising a first mass of material provided at a first pressure;

a second thermal energy reservoir comprising a second mass of material;

a conduit for containing and conveying the working fluid at a second pressure, and wherein the conduit defines a fluid flow path and extends through at least one of the first thermal energy reservoir and the second thermal energy reservoir;

wherein the conduit comprises a wall, the working fluid at the second pressure is contained within the conduit and thermal energy exchange between the working fluid and at least one of the first thermal energy reservoir and the second thermal energy reservoir is provided through the wall of the conduit;

a controller configured to receive information related to a position of at least one of the moveable pistons from at least one of a piston position sensor and a measured working fluid property, and wherein the controller is in communication with at least one of the plurality of valves and is configured to output a control signal to at least one of the plurality of valves to modulate a piston position at which at least one valve operates to control at least one of outlet temperature, outlet pressure, and mass flow rate through at least one cylinder wherein the moveable pistons comprise free pistons and the controller is operable to output a control signal to the motor-generator unit to control piston motion and limit a range of the piston to less than a piston's maximum range.

2. The system of claim 1, wherein the working fluid comprises air.

3. The system of claim 1, wherein at least one of the first mass and the second mass comprises at least one of molten salt, soil, gravel, rock, oil, water and ambient air.

4. The system of claim 1, further comprising a heat exchanger and wherein the heat exchanger is in fluid communication with the conduit and in thermal communication with at least one of the first thermal energy reservoir and the second thermal energy reservoir.

5. The system of claim 1, wherein the controller is operable to control a timing sequence of at least one the plurality of valves.

6. The system of claim 5, wherein the controller is operable to provide a current to at least one of the plurality of valves, and at least one of the plurality of valves comprises a solenoid valve.

7. A pumped heat system comprising:

a motor-generator unit;

a compressor-expander unit in communication with the motor-generator unit and wherein the compressor-expander unit is operable to impart and receive force to and from the motor-generator unit;

a plurality of valves associated with the compressor-expander unit, wherein each of the plurality of valves are operable to control a flow rate of a working fluid relative to the compressor-expander unit;

a conduit defining a fluid flow path for the working fluid, and wherein the fluid flow path comprises a path to convey thermal energy between the compressor-expander unit and a first thermal energy reservoir comprising a first mass of material wherein the first thermal energy reservoir is provided at a first pressure;

wherein the system is operable to perform work on the working fluid to convert energy to thermal energy and transfer the thermal energy to the first thermal energy reservoir and wherein the system is operable to perform work on the compressor-expander unit to convert thermal energy to mechanical energy;

a position sensor operable to monitor a position of a free piston provided in the compressor-expander unit;

a controller in communication with the position sensor and configured to receive information related to at least one of the position of the free piston and a working fluid property;

wherein the controller is in communication with at least one of the plurality of valves; and wherein the controller is further configured to output a control signal to at least one of the plurality of valves to modulate a piston position at which the at least one of the plurality of valves operates wherein the compressor expanded unit comprises a plurality of free pistons and the controller is operable to output a control signal to the compressor-expander unit to control piston motion and limit a range of the piston to less than a piston's maximum range.

8. The system of claim 7, wherein the compressor-expander unit comprises a plurality of cylinders and a plurality of reciprocating pistons.

9. The system of claim 7, wherein the working fluid comprises air.

10. The system of claim 7, wherein the first mass comprises at least one of soil, gravel, rock, oil, water and ambient air.

11. The system of claim 10, wherein the system comprises a second thermal energy reservoir.

12. The system of claim 7, wherein the compressor-expander unit comprises a plurality of free pistons.

13. The system of claim 7, wherein the controller is operable to receive information related to a position of the free piston and is further operable to send control signals to the motor-generator unit.

14. The system of claim 1, wherein the controller is operable to selectively provide a cylinder of the plurality of cylinders in at least one of an expansion mode, a compression mode, and an inactive mode.

15. The system of claim 1, wherein the fluid flow path comprises a first heat exchanger in communication with the first thermal energy reservoir and a second heat exchanger in communication with the second thermal energy reservoir.

16. The system of claim 15, wherein a first cylinder of the plurality of cylinders comprises a first valve of the plurality of valves in fluid communication with a first side of the first heat exchanger and a second valve of the plurality of valves in fluid communication with a second side of the first heat exchanger, and a third valve of the plurality of valves in fluid communication with a first side of the second heat exchanger and a fourth valve of the plurality of valves in fluid communication with a second side of the second heat exchanger.

17. The storage system of claim 7, wherein the controller is operable to selectively provide a cylinder of the plurality of cylinders in at least one of an expansion mode, a compression mode, and an inactive mode.

18. The system of claim 1, wherein the first pressure comprises atmospheric pressure.

19. The system of claim 7, wherein the first pressure comprises atmospheric pressure.

* * * * *